US009581390B2

(12) United States Patent
Peterle et al.

(10) Patent No.: US 9,581,390 B2
(45) Date of Patent: Feb. 28, 2017

(54) BIPHASIC HEAT EXCHANGE RADIATOR WITH OPTIMISATION OF THE BOILING TRANSIENT

(75) Inventors: Michele Peterle, San Pietro di Feletto (IT); Simone Visentin, Santa Lucia di Piave (IT); Diego Trentin, Mareno di Piave (IT); Federico Zoppas, Treviso (IT)

(73) Assignee: I.R.C.A. S.P.A. Industria Resistenze Corazzate e Affini, San Vendemiano (IT)

( * ) Notice: Subject to any disclaimer, the term of this patent is extended or adjusted under 35 U.S.C. 154(b) by 496 days.

(21) Appl. No.: 14/240,958

(22) PCT Filed: Aug. 24, 2012

(86) PCT No.: PCT/IB2012/054292
§ 371 (c)(1),
(2), (4) Date: Feb. 25, 2014

(87) PCT Pub. No.: WO2013/027193
PCT Pub. Date: Feb. 28, 2013

(65) Prior Publication Data

US 2014/0199054 A1 Jul. 17, 2014

(30) Foreign Application Priority Data

Aug. 25, 2011 (IT) ..... RM2011A0447

(51) Int. Cl.
*F28F 27/00* (2006.01)
*F28D 1/02* (2006.01)
(Continued)

(52) U.S. Cl.
CPC ..... *F28D 1/0226* (2013.01); *F24H 3/004* (2013.01); *F28D 15/02* (2013.01); *F28F 1/022* (2013.01);
(Continued)

(58) Field of Classification Search
CPC ..... F28D 1/0226; F28D 15/02; F24H 3/004; F28F 1/42; F28F 1/022
(Continued)

(56) References Cited

U.S. PATENT DOCUMENTS 3,444,419 A * 5/1969 Hansen ..... F28D 15/02 165/104.23
4,503,906 A 3/1985 Andres et al.
(Continued)

FOREIGN PATENT DOCUMENTS

| | | |
|---|---|---|
| EP | 2012080 | 1/2009 |
| JP | 62131121 | 6/1987 |
| WO | 00/70289 | 11/2000 |

OTHER PUBLICATIONS

International Search Report and Written Opinion dated Nov. 15, 2012 for corresponding international patent application No. PCT/IB2012/054292.

*Primary Examiner* — Ljiljana Ciric
(74) *Attorney, Agent, or Firm* — Abelman, Frayne & Schwab

(57) ABSTRACT

A radiator of the thermosiphon type comprising a collector situated in the lowest part of the radiator, and adapted to contain an intermediate vector fluid, an external heat source, placed within the collector, wherein the intermediate vector fluid is adapted to evaporate on contact with a hot surface of the external heat source, at least one vertical tube containing therein one or more channels (4) connected to the collector and communicating with the same, characterized in that said collector and said channels are dimensioned so that each section thereof crossed by the intermediate vector fluid, excluding the thickness of the liquid film of moisture, has the smallest linear direction which is twice bigger than the diameter db of an intermediate fluid vapor bubble which,
(Continued)

during operation, detaches itself from the hot surface of the external source during boiling of the intermediate fluid.

10 Claims, 8 Drawing Sheets

(51) Int. Cl.

| | |
|---|---|
| ***F24H 3/00*** | (2006.01) |
| ***F28D 15/02*** | (2006.01) |
| *F28F 1/42* | (2006.01) |
| *F28F 13/18* | (2006.01) |
| *F28F 1/02* | (2006.01) |
| *F28F 1/26* | (2006.01) |

(52) U.S. Cl.
CPC . *F28F 1/26* (2013.01); *F28F 1/42* (2013.01); *F28F 13/187* (2013.01)

(58) Field of Classification Search
USPC ..... 165/128, 129, 130, 131
See application file for complete search history.

(56) References Cited

U.S. PATENT DOCUMENTS

| | | | | |
|---|---|---|---|---|
| 2009/0041441 | A1 | 2/2009 | Marechal et al. | |
| 2013/0048254 | A1* | 2/2013 | Livingston | H01L 23/427 165/104.29 |
| 2013/0213613 | A1* | 8/2013 | Hammerbeck | F03B 13/00 165/104.27 |
| 2014/0199055 | A1* | 7/2014 | Peterle | F28D 1/0226 392/377 |

* cited by examiner

BIPHASIC HEAT EXCHANGE RADIATOR WITH OPTIMISATION OF THE BOILING TRANSIENT

CROSS REFERENCE TO RELATED APPLICATIONS

This application is a national phase of PCT application No. PCT/IB2012/054292, filed Aug. 24, 2012, which claims priority to IT patent application No. RM2011A000447, filed Aug. 25, 2011, all of which are incorporated herein by reference thereto.

FIELD OF THE INVENTION

The present invention relates to radiators and radiating plates, which use an intermediate vector fluid, in the biphasic state, to provide a heat exchange with the external environment.

STATE OF THE ART

The devices, such as radiators or radiating panels, which use a fluid in the biphasic state, are characterised by an external heat source, generally of compact dimensions (e.g. a commercial electric heater) which heats an intermediate vector fluid contained within the radiator. The aforementioned intermediate vector fluid, receiving thermal energy from the external source, passes to the biphasic state and is maintained in this thermodynamic state of vapour/liquid balance, during normal and transient operation of the heating device.

The vector fluid in contact with the hot surface of the external source is vaporised and rises into the specific channels obtained within the vertical pipes engaged with/connected to said radiator collector.

On contact with the wall of these channels, which is colder since it is in direct contact with the external environment to be heated, the vector fluid condenses forming a condensed liquid film which provides the heat exchange with the wall, transferring the heat received from the external source to the radiator body and therefore to the external environment.

The film of condensate descends, running along the channel walls up to the collector, coming into contact again with the hot surface of the external source, re-initiating the evaporation and condensation cycle. (FIGS. 2*a*, 2*b*)

In many cases, the film condensation on the walls of the aforementioned channels does not occur, due to incorrect measurements of the mechanical parts of the radiator body and non-optimal control of the heat exchange transient for boiling the vector fluid in contact with the external source.

If not correctly dimensioned, the efflux channels cause an excessive acceleration of the vapour which, rising at high speed, prevents the re-descent or even the formation of the liquid film on the channel walls themselves, causing phenomena, such as drops of condensation, which are damaging for the heat exchange and above all causing over temperatures of the fluid, especially close to the external source surface.

In these conditions, the film of condensate descends slowly due to the obstruction caused by the excessive speed of the mass of vapour which rises back up the channels leaving the external heat source surface without or only partly covered by the liquid which is also necessary for the cooling thereof. In essence, the highly overheated vapour creates a "plug" which prevents the return of the film of liquid towards the collector. The heat exchange from the external heat source to the vector fluid is therefore governed by the conduction through the vapour and the radiant exchange between overheated vapour and walls. The transfer of heat from the evaporating area to the radiant part could be governed by a convective exchange in the overheated vapour. Therefore, the distinctive feature of the heat tubes is lost: The fact of being able to transfer the heat much faster than any other conductive means, with consequent lengthening of the times required to reach regime.

The phenomena of film boiling with decrease of the heat exchange can occur, which becomes almost completely of a convective nature, leading to over-temperatures which are damaging for the external source surface (with consequent decrease in the life of the component, high thermal stress phenomena, over-temperatures which accelerate corrosion phenomena) and, above all, for the fluid.

The fluids used are generally fluids from the hydrofluoroether family, and refrigerants deriving from the field of cryogenics which have a higher limit than the maximum operating temperature, above which chemical degradation occurs with formation of compounds which in some cases may corrode the structure itself of the radiator.

Therefore, the technical problem to be solved is that of creating appropriate conditions so that the radiator of the type described can take the best advantage of the biphasic heat exchange mechanism at regime and during the boiling transient. Such a radiator must be able to maintain the nucleate boiling regime where the temperatures of the fluid in contact with the external heat source are maintained below the so-called critical value with the maximisation of the heat exchange coefficient. Such a situation favours the reliability of the external heating component (external source), the fluid and the entire device.

SUMMARY OF THE INVENTION

The object of the present invention is to obtain a radiator which is capable of overcoming the described drawbacks. The object is obtained by means of a radiator of the thermosiphon type, which comprises, in accordance with claim 1, a collector situated in the lowest part of the radiator, and adapted to contain an intermediate vector fluid, an external heat source, placed within the collector, wherein the intermediate vector fluid is adapted to evaporate on contact with a hot surface of the external heat source in nucleate boiling regime, forming vapour bubbles having a diameter db which are characteristic of the intermediate vector fluid, which detach themselves from the hot surface of the external heat source during the nucleate boiling, at least one vertical tube containing therein one or more channels connected and communicating with the collector, characterised in that the smallest linear direction of every section of said collector and said channels crossed by the intermediate vector fluid, excluding the thickness of the liquid film of moisture, is between twice and five times the diameter db of said intermediate vector fluid vapour bubble.

Such a solution allows to avoid the phenomenon of obstruction, which prevents the film of condensate from falling in a sufficiently short time in order not to leave the external source surface free from liquid. Defining the size of the channels crossed by the intermediate vector fluid, according to the diameter db of an intermediate fluid vapour bubble, db being dependent on the type of intermediate vector fluid chosen and calculable for example by means of formulae which can be found in literature, or by means of tests and measurements carried out for each vector fluid chosen and detecting said bubble diameter db with appropriate and known detecting means, the heat exchange is optimised between the heat source, the intermediate vector fluid and the radiator walls.

BRIEF DESCRIPTION OF THE FIGURES

Further features and advantages of the invention will become clearer in view of the detailed description of several design criteria and from the embodiments of a radiator operating in the biphasic regime, also with the help of the drawings.

DETAILED DESCRIPTION OF A PREFERRED EMBODIMENT OF THE INVENTION

Figure 1A:
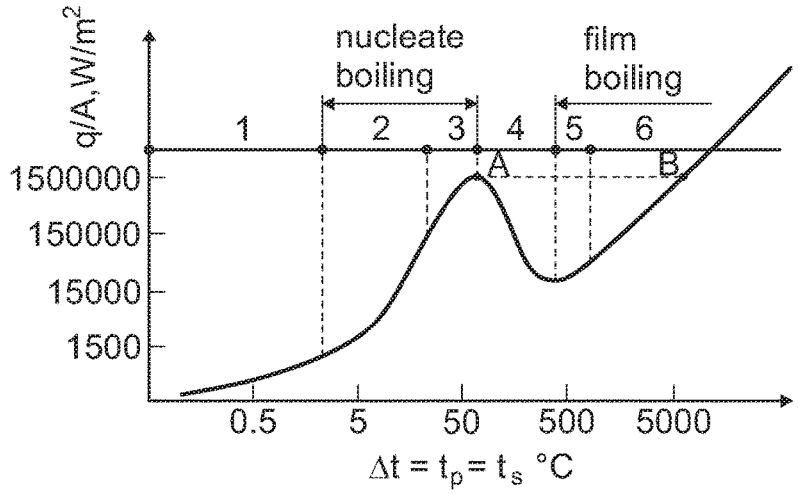
FIG. 1*a* shows the boiling curve which relates the thermal flow to the difference between the surface temperature of the external source in contact with the liquid and the saturation temperature of said liquid.
Figure 1B:
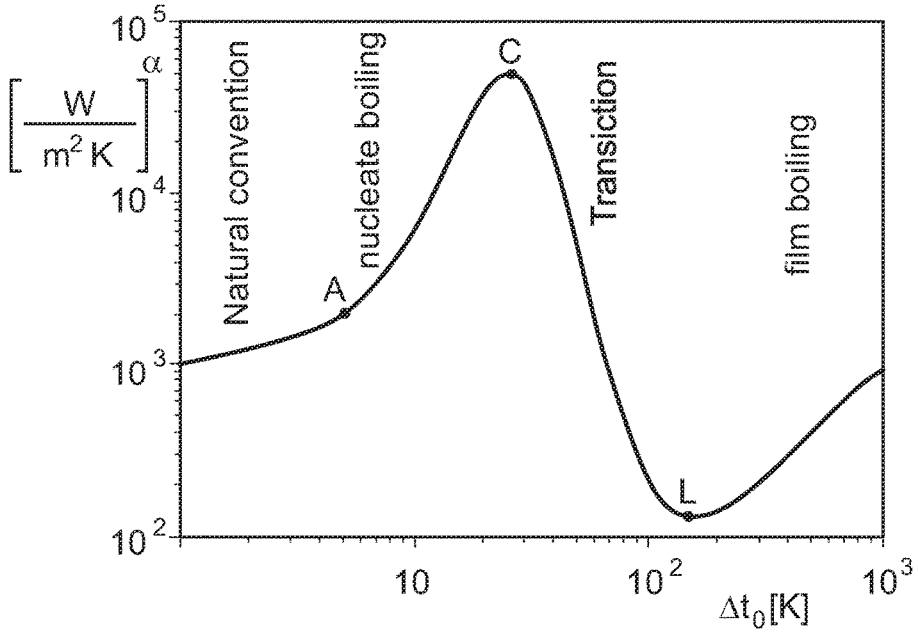
FIG. 1*b* shows the diagram of the source/fluid heat exchange coefficient in the biphasic state as a function of over-temperature, FIG. 2*a* and FIG. 2*b* schematically show a channel obtained within a vertical pipe of the radiator seen in cross-section, where the operating system is depicted, and where the external heat source is in direct contact with the fluid (FIG. 2*a*) or in indirect contact by means of the bottom wall of the channel (FIG. 2*b*).
Figure 2A:
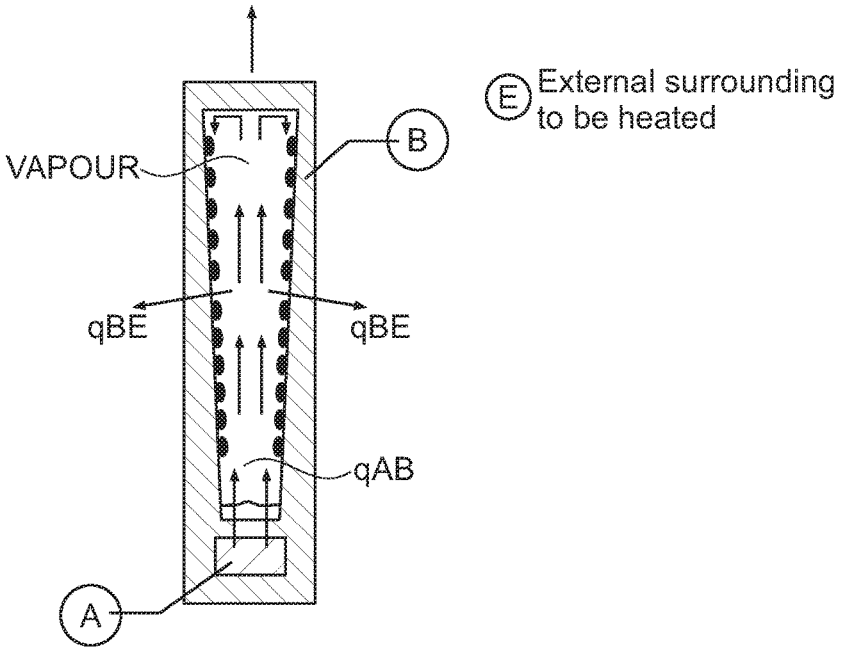
Figure 2B:
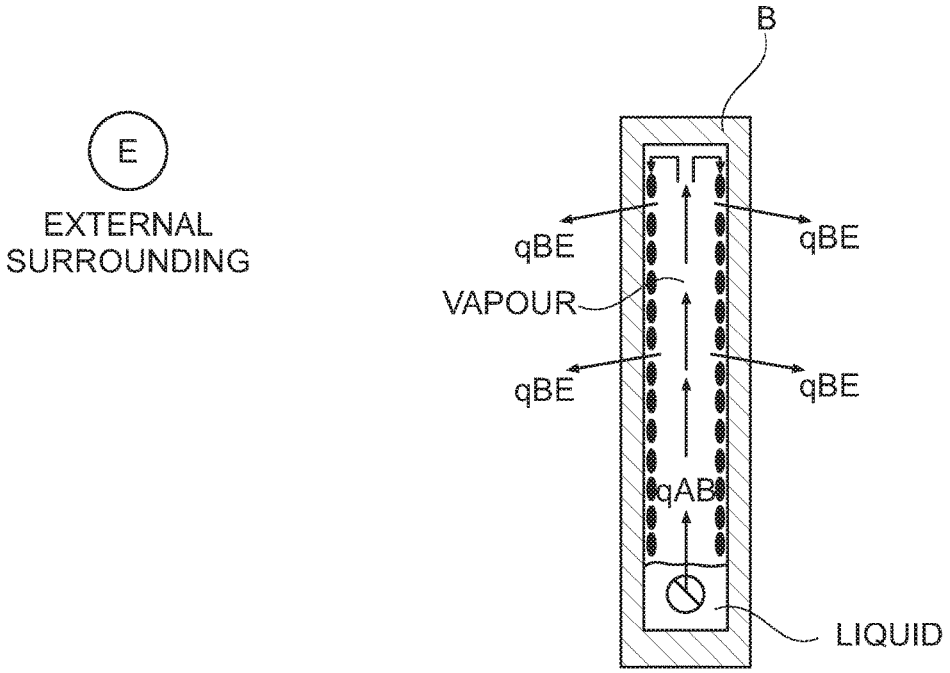

FIG. 1 shows the boiling curve as a function of the thermal flow and the difference between the surface temperature of the external heat source in contact with the liquid and the saturation temperature of said liquid. In area 1, the heat is only transmitted by convection; this area is characterised by a low heat exchange. As the temperature rises, the heat exchange quickly increases, in area 2, due to the formation of bubbles, wherein the phenomena of nucleated boiling occurs.

The nucleated boiling also continues in area 3, but the increase of the heat exchange with the rising of temperature tends to saturate until reaching point A, where the so-called critical flow occurs which is due to the paroxysmal increase of the number of bubbles which makes the heat exchange between the external source surface and the liquid increasingly difficult. The maximum efficiency, as can be seen from the curve in FIG. 1, occurs between area 2 and area 3. Beyond point A (FIG. 1), the heat exchange plunges while the temperature of the external source surface rises with damaging consequences for the same as for the fluid used. The temperature of the external source surface may also rise due to a lack of liquid which has also the function of cooling said surface. This may occur due to a lengthening of the re-descent time of the film of moisture due to the obstruction caused by the vapour bubbles which rise back up the channels. Therefore, it is necessary that a boiling regime is maintained around the point where area 2 and area 3 of the curve in FIG. 1 meet, and that the channels and the collector are correctly dimensioned. In accordance with the invention, the smallest linear dimension of the channel crossing section is at least twice the diameter $d_b$ of the vapour bubble. According to the intermediate vector fluid chosen, the vapour, bubble is univocal and always has the same dimensions, the fluid and working conditions being equal, e.g. as professed in Rohsenow et al.: "Heat, Mass and Momentum Transfer", Prentice-Hall, N.J., 1961:

$$d_b = C_d\beta\sqrt{\frac{2\sigma}{g(\varrho_l - \varrho_v)}} \tag{1}$$

where:

Ca=characteristic constant of the intermediate vector fluid,

β=angle of contact of the liquid on the wall

σ=surface tension

ρ=liquid and vapour density g=acceleration of gravity

By way of example, for the fluid HFE 7100 the formula becomes:

$$d_{bub} = 0.0208\beta l_c$$

$$l_c = \left[\frac{\sigma}{(\rho_l - \rho_v)g}\right]^{1/2}$$

and a bubble diameter of around 0.76 mm results. The fluid HFR 710010, is sold by 3M, and consists of hydrofluoroether.

Alternatively, this intermediate vector fluid can also be ethanol, or a synthetic polymer, such as R113 (chlorofluorocarbon).

It is also possible to obtain the bubble diameter for a specific vector fluid with detecting and measuring means of the known type, e.g. of the optical type, once the vector fluid has been chosen and the working conditions of the radiator to be designed have been defined. In this case, the section area of the vertical channels is obtained according to the fluid type and the various other variables of the design.

All formulae in the literature refer to geometries in which the thermal flow is uniform on the entire lateral surface.

In the case in which the section of the through channel of the intermediate vector fluid is not circular, it is necessary to consider the hydraulic diameter given by:

$$d_{idr} = \frac{4 \cdot A}{p}$$

$d_{idr}$=equivalent hydraulic diameter

A=section area of the channel p=channel perimeter (perimeter wetted by the liquid film)

The design condition becomes:

$$d_{idr_equivalent} > 2 \cdot d_b$$

with $d_b$=bubble diameter

Advantageously, the smallest linear dimension of the channel crossing section is at most 5 times the diameter db of the vapour bubble.

Figure 3:
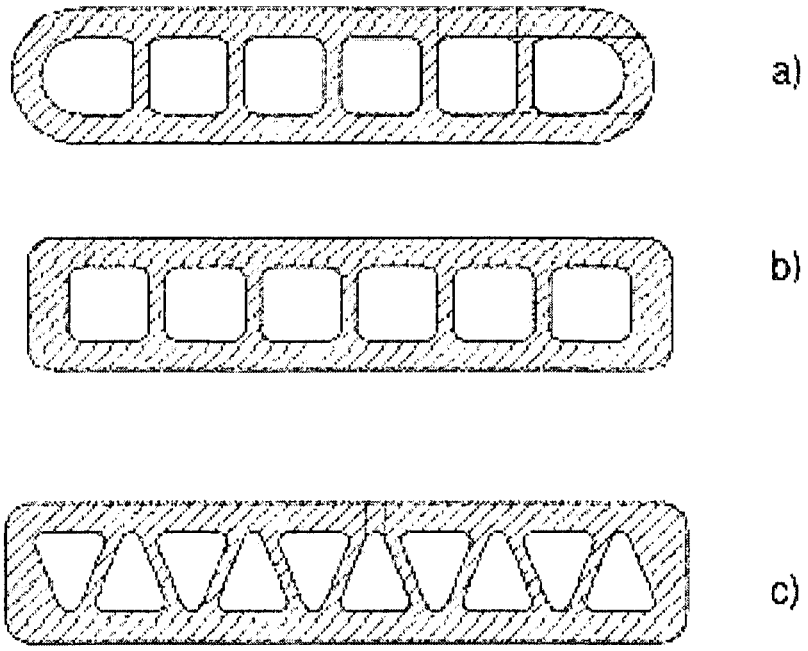
FIGS. 3*a*, 3*b*, 3*c* show possible shapes of efflux channels, with sections other than the circular shape.

The information relative to the bubble diameter is used to assess the shape of the section. The hydraulic diameter is not enough to dimension a through section". The through section of the efflux channel, several examples of which are given in FIG. 3, must not have narrowings or narrowed areas which are less than double the bubble diameter. The dimensions A1 and A2 must be at least twice the bubble diameter prior to detachment from the surface of the primary source of thermal flow (external source). The channel diameter must also be large enough to ensure that the draining of the fluid is only governed by the force of gravity, i.e. the surface tension is negligible. This should occur when the so-called Bond Bo number is >3, this condition determines the diameter of the efflux channel:

$$d_{idr} > \sqrt{BO} \cdot l_c = \sqrt{3} \cdot l_c$$

$$\text{with } lc = \sqrt{\cdot \sigma / g\Delta\rho}$$

This is the condition for there to be a "macrochannel" according to the definition by P. Cheng et al. (Mesoscale and Microscale Phase Change Heat Transfer, Advances in Heat Transfer Vol. 39, pp. 469-573, 2006). If this condition is not satisfied, the flow of moisture may be unstable. The problem of instability will become more dramatic with the decreasing of the channel diameter (when there are mini-channels and micro-channels) as the effect of the surface tension gradually becomes dominant.

Figure 4:
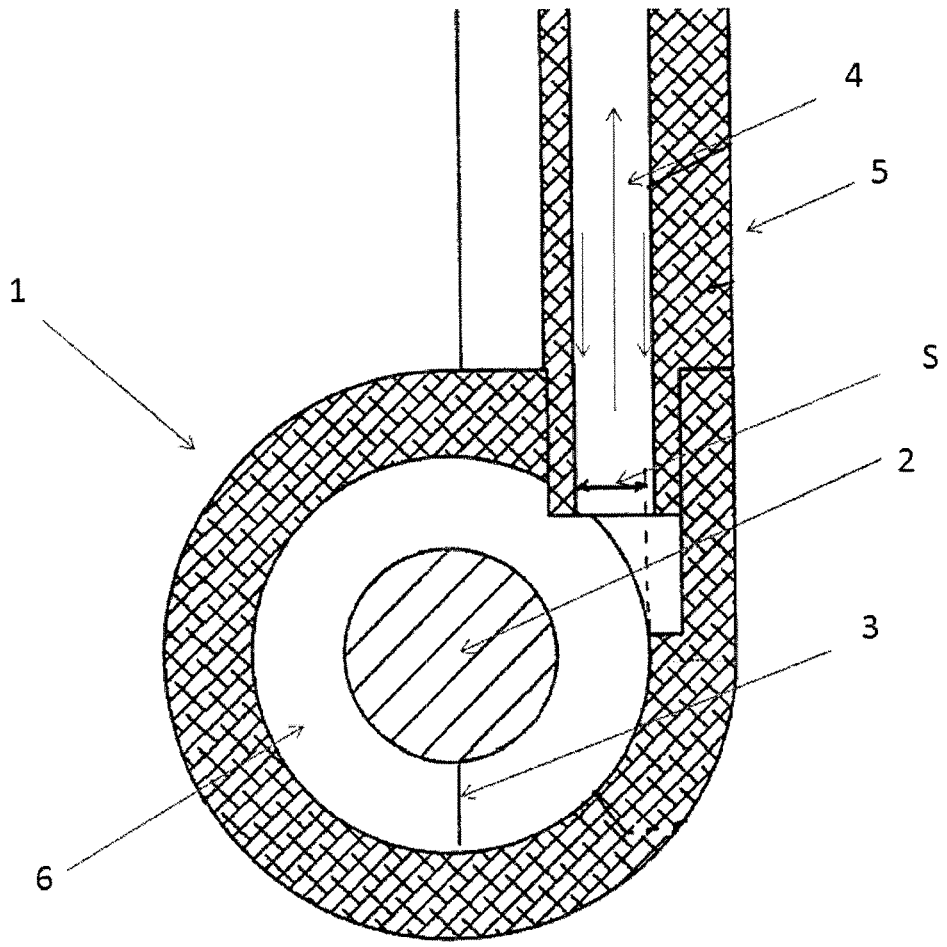
FIG. 4 shows, seen in cross-section, an embodiment of the vertical pipe with therein the efflux channel and the connection thereof to the collector.

FIG. 4 represents a possible embodiment of a radiator according to the invention.

Figure 5:
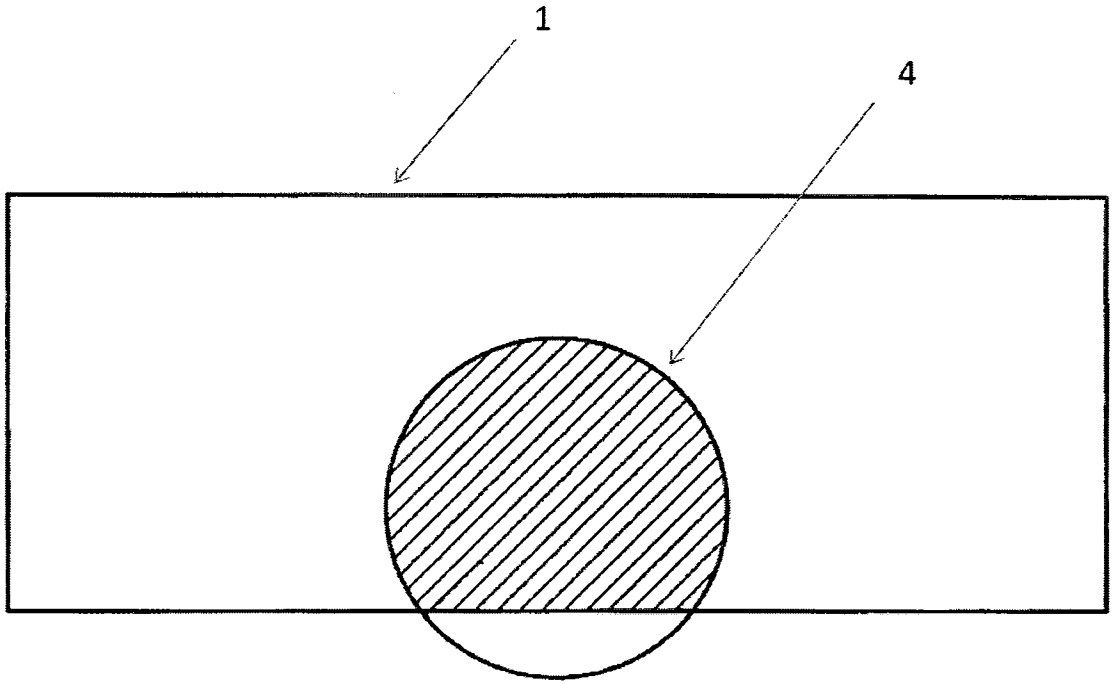
FIG. 5 shows the orthogonal projection of an efflux channel on the collector.
Figure 6:
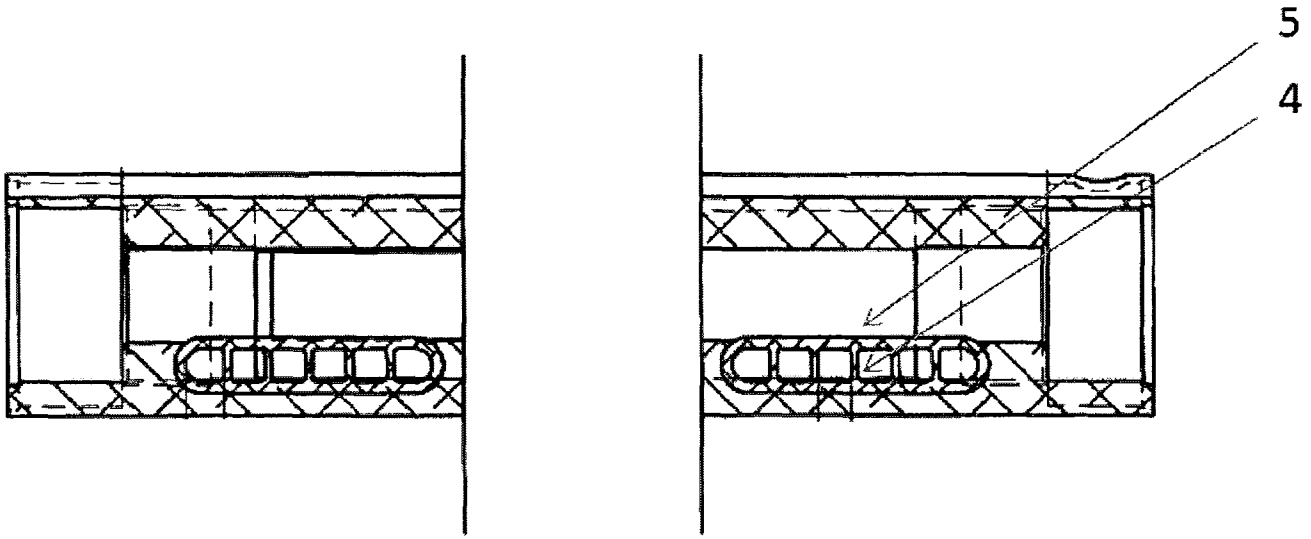
FIG. 6 is a representation of a section of the thermosiphon seen from above.
Figure 7A:
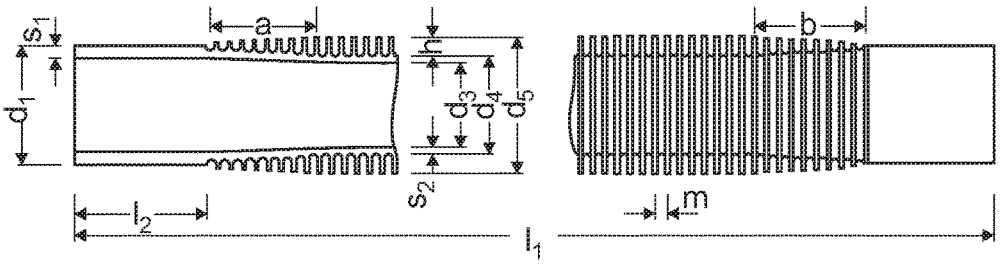
FIGS. 7*a*-7*e* show different types of micro-fins inserted onto the surface of the external heat source within the collector.
Figure 7B:
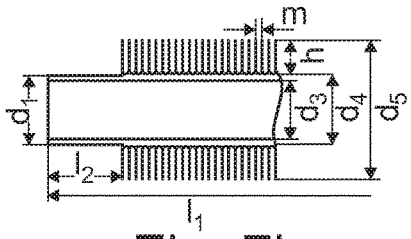
Figure 7C:
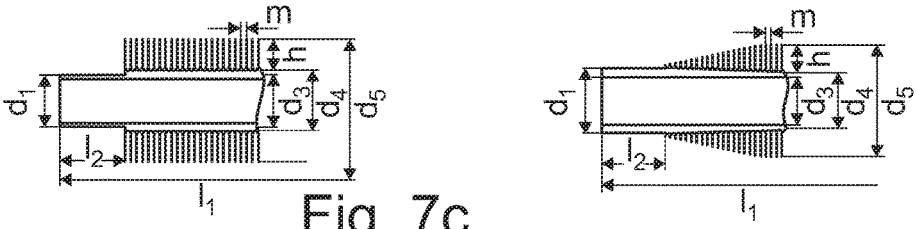
Figure 7D:
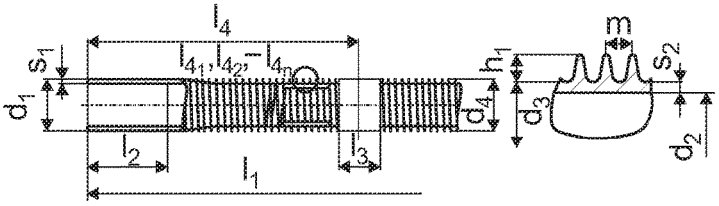
Figure 7E:
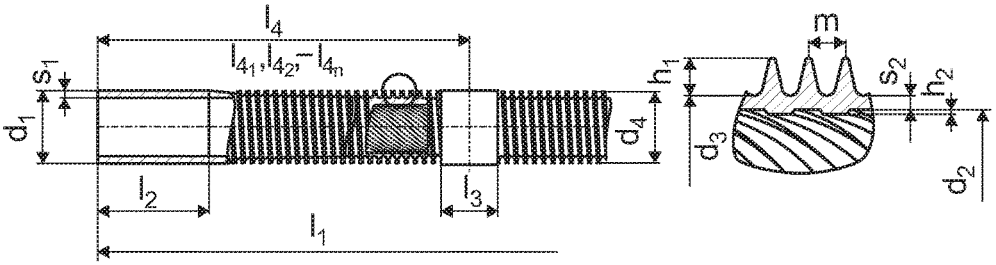

Collector 1 is formed by a circular-section pipe containing therein an external heat source 2, and an intermediate vector fluid which is initially, i.e. when the heating is still absent, in the liquid state. Efflux channel 4 is obtained within a vertical pipe 5, the walls of which are in contact with the external environment. The two vertical arrows directed towards the collector represent the film of moisture which falls towards the collector, while the arrow directed upwards represents the vapour flow. S represents that part of section area 4 of the efflux channel, the orthogonal projection of which overlaps with the longitudinal section of the collector in the top plan view, see FIG. 5, area 4 which, in order to favour a correct efflux from the collector and the return of the film of condensate, must not be less than 80% of the section of the efflux channel. Another parameter which proved to be very important for the good operation of the thermosiphon, and therefore must be taken into account, see FIG. 6, concerns the degree of covering, defined as the relation between the sum of the net diameters of the vertical channels measured along the collector axis and the collector length, involved in the heat exchange, measured along the axis thereof, such a relation must be higher than 0.6. In the effective embodiment, the thermosiphon schematised in FIG. 6 should therefore have about sixty vertical efflux channels. In FIG. 4, the numeral 3 indicates the linear dimension of the orthogonal section of the part of the collector where the intermediate thermo-vector fluid can flow. As previously described, all the sections of the channel and the collector must have a linear dimension which is at least twice greater than the bubble diameter as defined according to formula (1). In order not to exceed the critical flow threshold, point A of the curve in FIG. 1, it is also necessary to suitably dimension the surface of heat exchange interface 6 of the external source. By way of example, the critical thermal flow for fluid HFE 7100 is 22.6 W/cm$^2$, assessed at the fluid saturation temperature at around 90° C. It is also necessary to avoid the confinement effect of the fluid. The fluid must be able to evaporate and rise back up from the collector to the top of the radiator through the channels in the vertical pipes, flowing through sufficiently wide channels and spaces. The critical flow can easily be reached when the free space is reduced. The surface of interface 6 is preferably corrugated or equipped with suitable micro-fins, of various shapes as shown by FIGS. 7*a*-7*e*, so as to increase the number of nucleation points, i.e. the points where the bubbles are triggered, bearing in mind that any gap must have characteristic dimensions at least twice greater than the bubble diameter. In order to facilitate triggering the boiling/evaporation and condensation mechanism, even at low temperatures and low thermal flows from the external source, a suitable level of vacuum must be provided within the radiator; it will therefore be necessary to equip the radiator with suitable devices, such as valves with return springs, in order to be able, by means of pumps, to ensure the vacuum but also to be able to carry out the filling of said radiator. In this way, the boiling of the fluid is guaranteed, starting from a thermodynamic state characterised by a dominant pressure which is lower than the normal atmospheric pressure and therefore with a fluid boiling temperature which is lower than the corresponding one at normal room pressure. The described radiator is also equipped with a feedback-type control system to prevent the fluid reaching such a temperature as to exceed the critical thermal flow threshold, point A of the curve in FIG. 1. A bulb in direct contact with the fluid present in the biphasic state close to the exchange surface of external source (6, FIG. 4) detects the fluid temperature; said temperature value is then transformed into an electric signal which can thus be processed by means of control electronics suitably integrated in the radiator. The feedback-type control system allows to control the fluid temperature of the fluid so that it does not exceed a determined value, adjusting the intensity of the thermal flow supplied by the external source; such adjustment will modulate the thermal flow of the external source so as to remain in the curve stretch corresponding to nucleate boiling (stretches 2, 3 of the curve in FIG. 1). It has been discovered that using fluids particularly from the hydrofluoroether family, the critical flow is a function of the room temperature (coinciding with the temperature of the fluid before it is heated by the thermal source, e.g. the electrical resistor). Before being heated, the radiator is at room temperature (therefore "cold") and is fed by the thermal source in direct contact with the fluid. In particular, even in the most severe case in which, starting from the room temperature, the radiator is fed at the maximum electrical power, the temperature of the thermal source surface takes on rather high peak temperature values in the first instants of operation and for a good period of the transient, before reaching the regime. In order to limit this temperature peak, and therefore limit the fluid temperature in the transient, a "soft start" is implemented in the algorithm of the control electronics.

Figure 8:
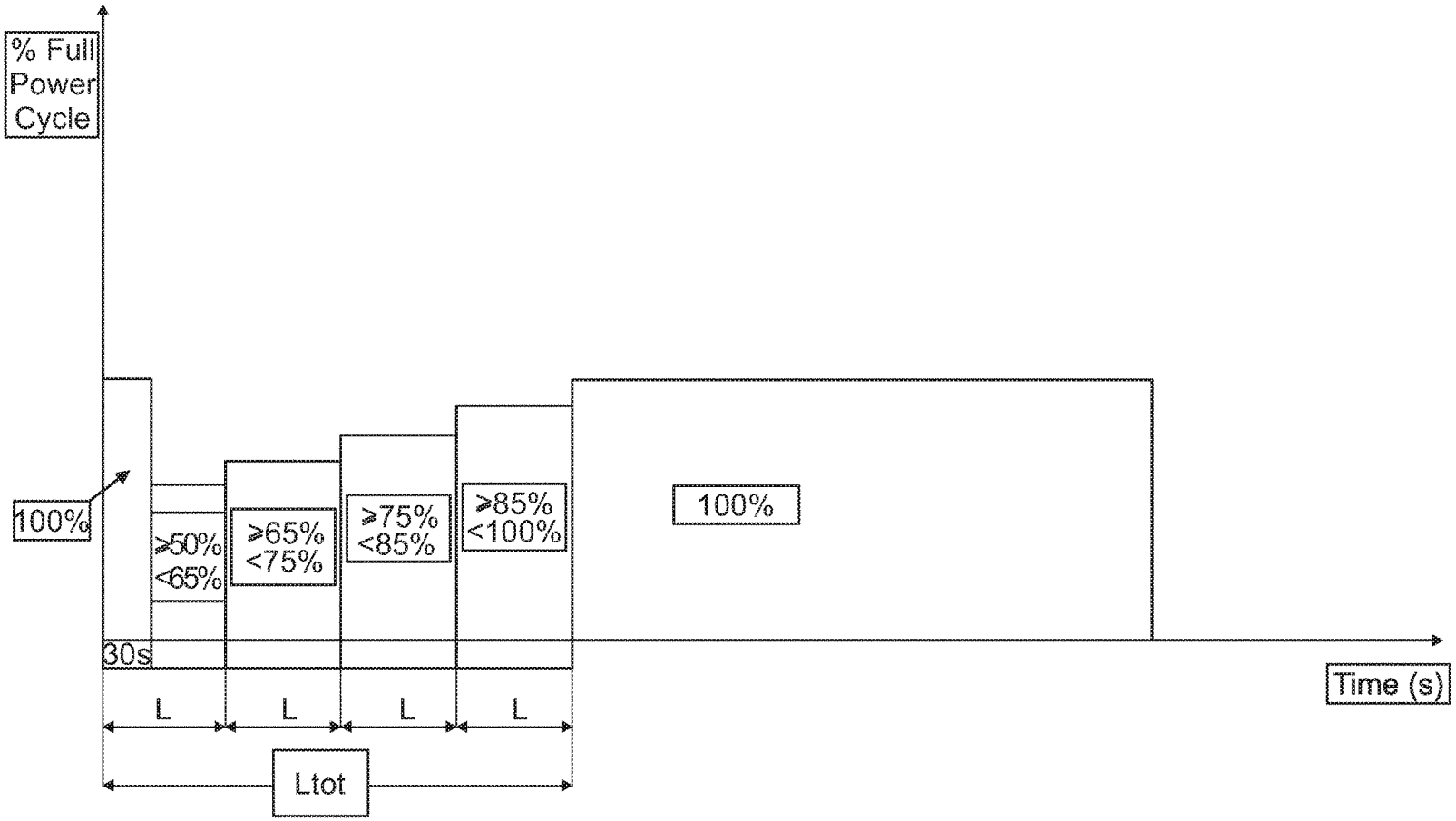
FIG. 8 shows a graph showing the transient phase of the intermediate vector fluid heating.

The electronics modulate/choke the thermal power supplied by the heater in direct contact with the fluid so as to maintain/control the fluid temperature below the critical temperature at which the chemical degradation of the fluid begins. FIG. 8 represents a time graph of the heating pattern during the transient phase. In the first 30 seconds, the radiator supplies full power in order to preheat the fluid and cause it to largely evaporate. It then supplies between 50 and 65% for a total time "L" (which in the first choking comprises 100% for thirty seconds plus 50-65% for the remaining L−30 sec). The other stretches with incremental power then follow which last the same time L. The duration of each interval depends on the room temperature at which the radiator is found when the feeding/heating step begins (starting from cold). The lower the room temperature, the greater the duration L of the power step must be. It is possible to calibrate the duration of each interval based on various intervals of room temperature. The system with incremental powers and durations L has the function of gradually causing the fluid to evaporate, keeping the boiling regime in the nucleate boiling phase by allowing the vapour to reach the top of the vertical pipes and giving the liquid film time to re-descend, wetting and cooling the electrical resistor, maintaining the fluid temperature at the fluid source interface below the temperature of chemical degradation. According to the complexity of the regulator and the calculation resources, it is possible to vary both the duration L and the corresponding choked power, creating more steps than those represented in the figure (continuous adjustment of the soft start). As a function of the temperature detected by the sensor placed within the radiator at the fluid-source interface, the choked power and the corresponding duration L are varied so as maintain the fluid temperature below the limit value. If the temperature at the fluid source interface exceeds the limit, the electronic control will immediately provide for decreasing the supplied instantaneous power and increasing the corresponding duration L. The soft start has a total duration (Ltot) and is interrupted when the radiator enters the adjusting mode of the room temperature (i.e. within the band of room temperature adjustment). The soft start has the advantage, keeping the boiling in the nucleated phase and limiting the temperature peak at the fluid source interface, of using thermal sources with high thermal flows per unit area. The described biphasic fluid-type radiator can be used in various applications where heat exchange is required with a surface at a specific temperature and thermal flow for constant unit area, e.g. in the industrial field for heating moulds or in the domestic field for hobs or heating rooms.

The invention claimed is:

1. A radiator of the thermosiphon type comprising a collector situated in the lowest part of the radiator, and adapted to contain an intermediate vector fluid an external heat source, placed within the collector, wherein the intermediate vector fluid is adapted to evaporate on contact with a hot surface of the external heat source in nucleate boiling regime, forming vapour bubbles having diameter db which are characteristic of the intermediate vector fluid, which detach themselves from the hot surface of the external heat source during the nucleate boiling, at least one vertical tube containing therein one or more channels connected and communicating with the collector, characterised in that the smallest linear dimension of every section of said collector and said channels crossed by the intermediate vector fluid, excluding the thickness of the liquid film of moisture, is between twice and five times the diameter db of said intermediate vector fluid vapour bubble.

2. The radiator according to claim 1, wherein the channels are "macro-channels", i.e. in which the flow of the liquid towards the collector is governed solely by the force of gravity while the surface tension is negligible with respect to the force of gravity.

3. The radiator according to claim 2, wherein, during operation, the collector and the efflux channel have an internal pressure which is lower than normal atmospheric pressure, so as to favour the boiling-evaporation mechanism, even at low temperatures and low thermal flows from the external source.

4. The radiator according to claim 2, wherein the orthogonal projection of the section (S) of the efflux channel, which overlaps the longitudinal section of the collector is at least 80% of the orthogonal section of the efflux channel.

5. A The radiator according to claim 4, wherein the relation R between the sum of the net diameters of the efflux channels measured along the collector axis and the collector length affected by the heat exchange, measured on the collector axis, is greater than 0.6.

6. The radiator according to claim 1, comprising a bulb for measuring the temperature which is placed in direct contact with the fluid present in the biphasic state close to the exchange surface of the external source; such measurement can be transformed into a signal which is processable by means of control electronics integrated into the radiator itself.

7. The radiator according to claim 6, comprising a feedback-type control system in order to prevent the fluid temperature exceeding a determined value by an adjustment of the intensity of the thermal flow supplied by the external source, such adjustment being configured to modulate the thermal flow of the external source so that the fluid remains in nucleate boiling regime during operation of the radiator.

8. A The radiator according to claim 7, wherein, during the transition period between the moment in which the intermediate vector fluid is at room temperature and the moment in which it reaches the desired temperature, the heating of the intermediate vector fluid is electronically controlled by using a suitable operating sequence which maintains the temperature of said fluid below the critical temperature at which the chemical degradation of the fluid begins.

9. The radiator according to claim 1, comprising a valve with a return spring in order to carry out a determined level of vacuum and in order to carry out the collector filling.

10. A The radiator according to claim 1, where surfaces with micro-fins are interposed between the external source and the intermediate vector fluid, in order to facilitate the generation of a greater number of bubbles.

* * * * *